US009144711B2

(12) United States Patent
Walker et al.

(10) Patent No.: US 9,144,711 B2
(45) Date of Patent: Sep. 29, 2015

(54) VIA FERRATA SAFETY SYSTEM

(75) Inventors: Ben Walker, Draper, UT (US); Brendan Perkins, Salt Lake City, UT (US); Bill Belcourt, Salt Lake City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 1387 days.

(21) Appl. No.: 12/193,608

(22) Filed: Aug. 18, 2008

(65) Prior Publication Data

US 2009/0235425 A1 Sep. 24, 2009

Related U.S. Application Data

(60) Provisional application No. 61/037,854, filed on Mar. 19, 2008.

(51) Int. Cl.

| | |
|---|---|
| ***A63B 29/02*** | (2006.01) |
| ***A62B 1/16*** | (2006.01) |
| ***A62B 35/04*** | (2006.01) |

(52) U.S. Cl.

CPC . *A63B 29/02* (2013.01); *A62B 1/16* (2013.01); *A62B 35/04* (2013.01)

(58) Field of Classification Search

CPC ... A41D 13/0015; A41D 13/02; A41D 27/08; A62B 35/04; A62B 27/00; E06C 7/003

USPC ..... 182/3, 9; 2/69

See application file for complete search history.

(56) References Cited

U.S. PATENT DOCUMENTS

| | | | | |
|---|---|---|---|---|
| 3,444,957 | A * | 5/1969 | Ervin, Jr. | 182/3 |
| 4,446,944 | A * | 5/1984 | Forrest et al. | 182/3 |
| 5,174,410 | A * | 12/1992 | Casebolt | 182/3 |
| 5,202,177 | A * | 4/1993 | Kamper | 442/186 |
| 5,279,386 | A * | 1/1994 | Cearley | 182/3 |
| 5,287,943 | A * | 2/1994 | Bell | 182/3 |
| 5,598,900 | A * | 2/1997 | O'Rourke | 182/3 |

(Continued)

FOREIGN PATENT DOCUMENTS

| | | |
|---|---|---|
| DE | 29901576 | 5/1999 |
| DE | 60313061 T2 | 12/2007 |

(Continued)

*Primary Examiner* — Katherine Mitchell
*Assistant Examiner* — Candace L Bradford
(74) *Attorney, Agent, or Firm* — Trent Baker; Baker & Associates PLLC

(57) ABSTRACT

The present invention relates to a via ferrata safety system that improves user safety by increasing the reliable activation of the energy absorption system. The via ferrata system includes a harness coupling member, two fixed cable coupling members, and an energy absorption system. The energy absorption system is coupled to both the harness coupling member and the two fixed cable coupling members. The two fixed cable coupling members are independently coupled to the energy absorption system and to one another. The coupling between the two fixed cable coupling members is proportionally weaker than the independent coupling between the two fixed cable coupling members and the energy absorption system. This proportional weakness of the coupling between the fixed cable coupling members allows each of the fixed cable coupling members to act independently in the event that one of the cable coupling members is coupled to a point between the user and the energy absorption system.

20 Claims, 3 Drawing Sheets

(56) References Cited

U.S. PATENT DOCUMENTS

| | | | | |
|---|---|---|---|---|
| D453,266 | S * | 2/2002 | Dreyfus et al. | D3/221 |
| 6,390,234 | B1 * | 5/2002 | Boyer | 182/3 |
| 6,533,066 | B1 * | 3/2003 | O'Dell | 182/3 |
| D490,938 | S * | 6/2004 | Wydner | D29/101.1 |
| 6,851,516 | B2 * | 2/2005 | Petzl et al. | 182/3 |
| 6,955,138 | B2 * | 10/2005 | DeBien | 119/776 |
| 7,467,604 | B1 * | 12/2008 | Werner et al. | 119/770 |
| 2002/0175024 | A1 * | 11/2002 | Kurtgis | 182/3 |
| 2003/0155177 | A1 * | 8/2003 | Petzl et al. | 182/3 |
| 2006/0213455 | A1 * | 9/2006 | Bien | 119/772 |
| 2006/0266581 | A1 * | 11/2006 | Tanaka et al. | 182/3 |
| 2007/0023231 | A1 * | 2/2007 | Gorman et al. | 182/3 |
| 2013/0292219 | A1 * | 11/2013 | Perner | 188/376 |

FOREIGN PATENT DOCUMENTS

| | | |
|---|---|---|
| FR | 2677258 | 12/1992 |
| GB | 2333532 A * | 7/1999 |
| WO | WO9312838 | 7/1993 |
| WO | WO0044445 | 8/2000 |

* cited by examiner

VIA FERRATA SAFETY SYSTEM

RELATED APPLICATIONS

This application claims priority to U.S. provisional application Ser. No. 61/037,854 filed Mar. 19, 2008, the contents of which are incorporated by reference.

FIELD OF THE INVENTION

The invention generally relates to a via ferrata safety system. In particular, the present invention relates to systems and methods of improved via ferrata system safety.

BACKGROUND OF THE INVENTION

Via Ferrata is an activity that allows participants to hike, climb, or scramble over terrain while attached to a fixed cable. Participants wear a safety harness and utilize some form of via ferrata attachment system to the fixed cable. Via ferrata systems generally include a harness attachment member, an energy absorption system, and two cable attachment members. In operation, if a user falls from the supportive surface and is no longer able to support their body weight, the via ferrata system transfers the falling force from the user's harness to the fixed cable, thus supporting the user. In addition, the energy absorption system reduces the force applied between the harness and the cable. This reduction in force is necessary to prevent bodily harm to the user and allows for particular materials to be implemented in the via ferrata system. The two cable attachment members are generally carabiner or snap hook type members that are selectively couplable.

One problem with existing via ferrata systems is the potential to deactivate the energy absorption system as a result of particular user actions. If the energy absorption system is deactivated, a user may sustain severe bodily harm and/or may perish. One scenario in which the energy absorption system has resulted in force absorption deactivation occurs when a user attaches one of the two cable attachment members to a region between the user and the energy absorption system. For example, a user may attach one of the cable attachment members directly to their harness after releasing the cable attachment member from the fixed cable. If a user falls in this scenario, conventional via ferrata systems do not reliably activate the energy absorption system. Unfortunately, incidents such as this have resulted in actual user deaths due to via ferrata system failure.

Therefore, there is a need in the industry for a via ferrata system that reliably activates the energy absorption systems in various user operational scenarios including attaching one of the cable attachment members to a location between the user and the energy absorption system.

SUMMARY OF THE INVENTION

The present invention relates to a via ferrata safety system. One embodiment of the present invention relates to a via ferrata system that improves user safety by increasing the reliable activation of the energy absorption system. The via ferrata system includes a harness coupling member, two fixed cable coupling members, and an energy absorption system. The energy absorption system is coupled to both the harness coupling member and the two fixed cable coupling members. The two fixed cable coupling members are independently coupled to the energy absorption system and to one another. The coupling between the two fixed cable coupling members is proportionally weaker than the independent coupling between the two fixed cable coupling members and the energy absorption system. In addition, the coupling between the two fixed cable coupling members may be configured to sever at a force less than the force required to sever or tensile break either of the two fixed cable coupling members individually. This proportional weakness of the coupling between the fixed cable coupling members allows each of the fixed cable coupling members to act independently in the event that one of the cable coupling members is coupled to a point between the user and the energy absorption system. Additional embodiments of the invention relate to a method of manufacturing a via ferrata system incorporating the above described safety features.

Embodiments of the present invention represent a significant advancement in the field of via ferrata systems. In addition, these advancements increase the safe operation of these systems, thereby preventing inadvertent injury to users who participate in this activity. Conventional systems fail to reliably engage the energy absorption system in scenarios in which one of the fixed cable coupling members is attached to a location between the user and the energy absorption system. Embodiments of the present invention incorporate an improved safety system in which the fixed cable coupling members are independently coupled to the energy absorption system. In addition, the described systems maintain efficient operation of the via ferrata system under normal usage by including the proportionally weaker coupling between the two fixed cable coupling members.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
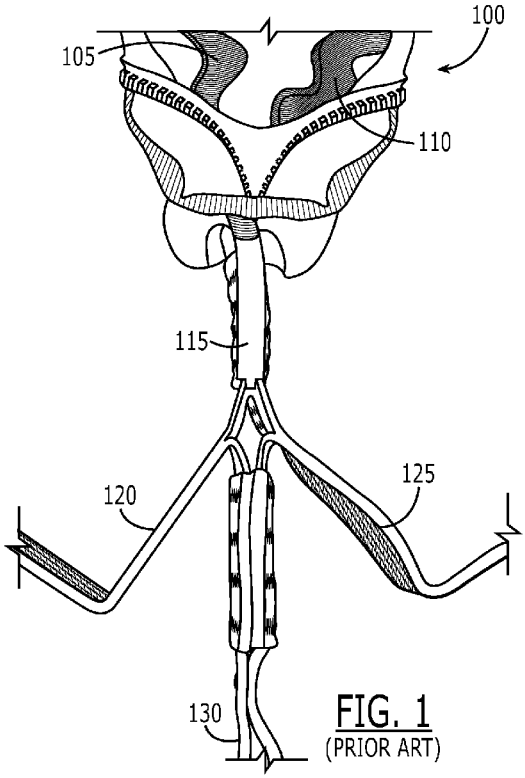
FIG. 1 (PRIOR ART)
FIG. 1 illustrates a perspective view of a portion of a common coupling via ferrata system.

The present invention relates to a via ferrata safety system. One embodiment of the present invention relates to a via ferrata system that improves user safety by increasing the activation operation of the energy absorption system. The via ferrata system includes a harness coupling member, two fixed cable coupling members, and an energy absorption system. The energy absorption system is coupled to both the harness coupling member and the two fixed cable coupling members. The two fixed cable coupling members are independently coupled to the energy absorption system and to one another. The coupling between the two fixed cable coupling members is proportionally weaker than the independent coupling between the two fixed cable coupling members and the energy absorption system. In addition, the coupling between the two fixed cable coupling members may be configured to sever at a force less than the force required to sever or tensile break either of the two fixed cable coupling members individually. This proportional weakness of the coupling between the fixed cable coupling members allows each of the fixed cable coupling members to act independently in the event that one of the cable coupling members is coupled to a point between the user and the energy absorption system. Additional embodiments of the invention relate to a method of manufacturing a via ferrata system incorporating the above described safety features. Also, while embodiments are described in reference to via ferrata safety systems, it will be appreciated that the teachings of the present invention are applicable to other areas, including but not limited to via ferrata operation systems and rock climbing systems.

The following terms are defined as follows:

DEFINITIONS

Via ferrata system—a system configured for coupling between a user's harness and a fixed cable during participation in a via ferrata activity.

Fall—a fall occurring during the activity of via ferrata includes a user becoming disconnected from the supportive surface, thereby transferring their entire body weight to the via ferrata system for support. A fall causes an expansion force between the user and the fixed cable to which the via ferrata system is coupled. The expansion force is distributed across the via ferrata system and affected by an energy absorption system so as to minimize the expansion force exerted upon the user while still supporting the user.

Energy absorption system—any system configured to absorb or reduce an expansion force.

Tear webbing system—a type of energy absorption system comprising folded webbing material stitched upon itself in a particular configuration. The stitching is configured to tear at a force lower than the webbing itself, thereby absorbing forces while maintaining lengthwise coupling. It will be appreciated that the term "tear" may describe any form or amount of tearing including partial tearing of the system. A tear webbing system will therefore elongate as a result of the tearing.

Coupling—a union between two members or components.

Sever—a decoupling between two members or components. For example, a stitched coupling between two nylon members may sever at a particular expansion force corresponding to the composition and/or number of stitches. It will be appreciated that magnitude of force required to sever a particular coupler/coupling refers to an expansion force exerted upon the coupling, and therefore the magnitude may be affected by the inclusion of a parallel and/or distributed force.

Tensile break—a lengthwise structural failure of a particular member. For example, a nylon member may break at a particular tensile force corresponding to the thickness and/or composition of the nylon. It will be appreciated that the magnitude of force required to tensile break a particular coupler/coupling refers to an expansion force exerted upon the coupling and therefore the magnitude may be affected by the inclusion of a parallel and/or distributed force. The force required to cause a tensile break of a particular member may also be referred to as the "tensile strength" of the particular member.

Reference is initially made to FIG. 1, which illustrates a perspective view of a via ferrata system that utilizes a common coupler, designated generally at 100. Only a coupler region of the system 100 is illustrated for reference purposes. The system 100 includes a harness coupling member 130, two fixed cable coupling members 105, 110 (only a portion of which are shown), and an energy absorption system 120, 125. The illustrated energy absorption system 120, 125 is a tear webbing system. The illustrated region particularly illustrates the coupling and positioning configuration between the components of the system 100. In particular, the energy absorption system 120, 125 is disposed and coupled between the two fixed cable coupling members 120, 125 and the harness coupling member 130. In the illustrated system 100, the coupling between the energy absorption system 120, 125 and the two fixed cable coupling members 105, 110 is referred to as the common coupler and is designated at 115. The common coupler 115 is a single coupling that both couples the two fixed cable coupling members 105, 110 to one another and to the energy absorption system 120, 125. In particular, the common coupler 115 is comprised of two nylon pieces stitched together to form a single member. Therefore, the fixed cable coupling members 105, 110 are not independently coupled to the energy absorption system 120, 125 but rather commonly coupled to the energy absorption system 120, 125 via the common coupler 115. The common coupling of the fixed cable coupling members 105, 110 can result in system failure if one of the fixed cable coupling members 105, 110 is directly coupled to a location between the energy absorption system 120, 125 and the user. This scenario may result in deactivating at least some of the energy absorption system 120, 125 by statically transferring the load from the user to the cable via the particular fixed cable coupling member 105, 110 which is coupled between the energy absorption system 120, 125 and the user. In addition, this scenario may also result in total system failure in which one of the two fixed cable coupling members 105, 110 severs or tensile breaks, thereby disconnecting the user from the fixed cable.

Figure 2:
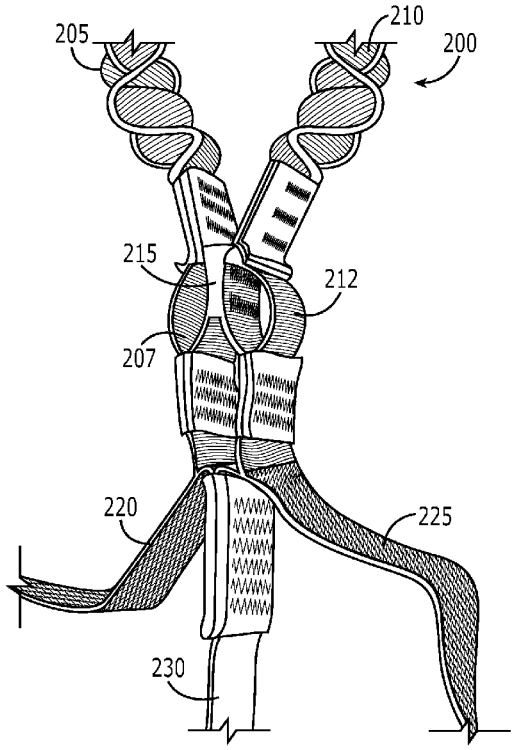
FIG. 2 illustrates a perspective view of a portion of a via ferrata system in accordance with one embodiment of the present invention.

Reference is next made to FIG. 2, which illustrates a portion of a via ferrata system in accordance with one embodiment of the present invention, designated generally at 200. The illustrated via ferrata system 200 includes a harness coupling member 230, two fixed cable coupling members 205, 210, and an energy absorption system 220, 225. The illustrated system utilizes members composed of static and dynamic materials such as nylon, but it will be appreciated that other materials may be used in accordance with the present invention. The illustrated energy absorption system is a tear webbing system including two folded nylon members 220, 225 stitched or coupled so as to create a zipper effect. The zipper effect of the two folded nylon members 220, 225 may reduce and/or absorb an expansion force between the fixed cable coupling members 205, 210 and the harness coupling member 230. This type of energy absorption system is well known in the industry and commonly used in conventional via ferrata systems and other rock climbing energy absorption systems. The two fixed cable coupling members 205, 210 are independently coupled to the energy absorption system via respective independent couplings 207, 212. In addition, the two fixed cable coupling members 205, 210 are coupled to one another via a common coupling 215. In the illustrated embodiment, the common coupling 215 includes two nylon members stitched together. The common coupling 215 may optionally be coupled independently to the energy absorption system 220, 225, as illustrated in FIG. 2. The common coupling 215 allows for efficient normal usage of the two fixed cable coupling members 205, 210 by distributing forces from the user to either and/or both of the two fixed cable members 205, 210 via the energy absorption system 220, 225. The common coupling 215 is specifically configured to sever at a force less than a force required to tensile break or sever the independent couplings 207, 212 between each of the two fixed cable coupling members 205, 210 and the energy absorption system 220, 225. Therefore, the common coupling 215 is weaker than the independent couplings 207, 212. With reference to the illustrated common coupling 215, the term "sever" may refer to the decoupling or separation of the two nylon members via scenarios including but not limited to destitching and/or some form of tensile break at the location of the common coupling 215. In addition, the common coupling 215 is configured to sever at a force less than the force necessary to tensile break either of the two fixed cable coupling members 205, 210. It will be appreciated that the description of the force at which the common coupling 215 severs is described in reference to an expansion force configuration between the two fixed cable coupling members 205, 210. An expansion force configuration causes a progressive or zipper tearing type sever of the common coupling 215. In contrast, if a parallel or distributed force is applied across the common coupling 215, it may not necessarily be described as weaker than the force necessary to independently sever either of the two fixed cable coupling members 205, 210.

Under normal via ferrata operation, and in the event of a user fall, the system 200 transfers the expansion force between the harness coupling members 230 and the two fixed cable coupling members 205, 210 to the energy absorption system 220, 225. Normal operation of a via ferrata system may include scenarios in which one or both of the two fixed cable coupling members 205, 210 are coupled to a fixed cable in accordance with standard via ferrata procedures. A fall results when the user loses support and thereby transfers their entire bodyweight to the via ferrata system 200 for support. As a result, an expansion force is applied upon the system 200 between the harness coupling member 230 (coupled to the user) and the fixed cable coupling members 205, 210 (one or both of which are coupled to a fixed cable). The expansion force progressively transfers throughout the system 200 and causes both sides of the energy absorption system 220, 225 to zipper/tear, thereby reducing and/or absorbing the magnitude of the expansion force on the system 200. The distributed expansion force causes the energy absorption system 220, 225 to tear before the other components and couplings because it is specifically configured to tear at a lower expansion force than other couplings and members in the system 200. In this scenario, the common coupling 215 will maintain the coupling between the two fixed cable coupling members 205, 210 to assist in transferring expansion forces resulting from a fall to the energy absorption system 220, 225.

In the unusual circumstance when a user couples one of the two fixed cable coupling members 205, 210 to a location between the user and the energy absorption system 220, 225, the system 200 will sever the common coupling 215 in order to ensure activation of the energy absorption system 220, 225. The location at which the user couples one of the two fixed cable coupling members includes but is not limited to a harness gear loop, harness belay loop, harness leg loop, the harness coupling member 230, etc. In this scenario, a user fall may result in a deactivation of the energy absorption system 220, 225. Since only one of the two fixed cable coupling members 205, 210 is coupled to the fixed cable, a user fall will result in an expansion force between the user and the one coupled fixed cable coupling member 205, 210. However, the substantially static elongation between the two fixed cable coupling members may cause the energy absorption system to be deactivated or partially deactivated. Therefore, the common coupling 215 is specifically configured to sever in this scenario, thereby allowing the one coupled fixed cable coupling member 205, 210 to at least partially activate the energy absorption system 220, 225 without risking individual breakage of the one coupled fixed cable coupling member 210.

Figure 3:
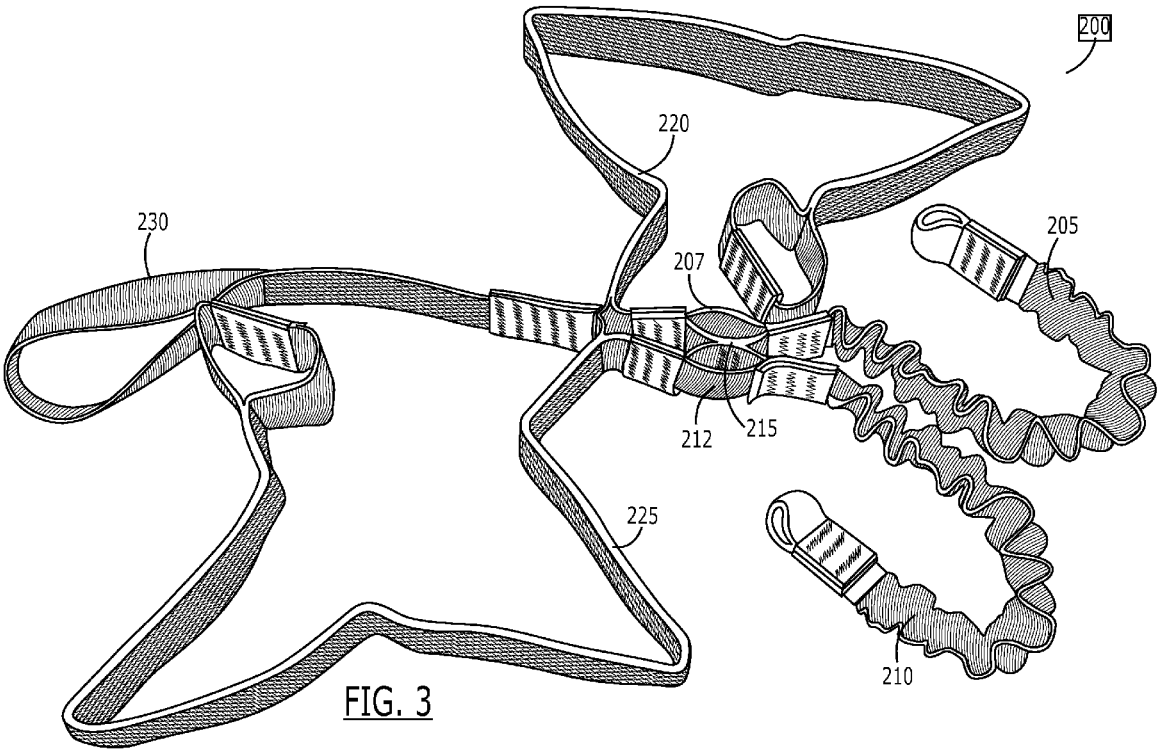
FIG. 3 illustrates a perspective view of an expanded via ferrata system in accordance with embodiments of the present invention.

Reference is next made to FIG. 3, which illustrates a perspective view of an expanded via ferrata system in accordance with embodiments of the present invention, designated at 200. The illustration shows a complete expanded via ferrata system including the full force absorption members 220, 225 and the full fixed cable coupling members 205, 210. The illustrated energy absorption members 220, 225 each include a loop of nylon material lengthwise stitched to itself to enable energy absorption as the stitching tears and the corresponding loop is elongated. The process of tearing and elongation of tear webbing systems is commonly referred to as zippering. The fixed cable coupling members 205, 210 include elastic materials to lengthwise compress the respective lengths of the fixed cable coupling members 205, 210 when they are not loaded and/or weighted. The lengthwise compression of the fixed cable coupling members 205, 210 may increase system performance by preventing unnecessary snagging on objects. Various alternative materials, coupling types, and energy absorption systems may be used in accordance with the present invention.

Figure 4:
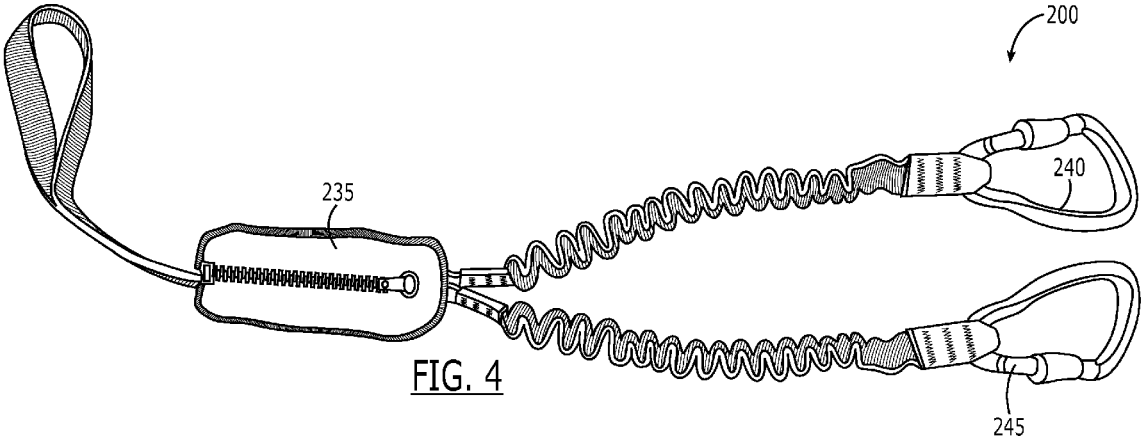
FIG. 4 illustrates a perspective view of an operational via ferrata system in accordance with embodiments of the present invention.

Reference is next made to FIG. 4, which illustrates a perspective view of an operational via ferrata system in accordance with embodiments of the present invention, designated generally at 200. The illustration further includes configuring the system 200 into an operational state by including carabiners 240, 245 on the ends of the fixed cable coupling members to facilitate releasably coupling with a fixed cable during participation in via ferrata. The carabiners 240, 245 are routed through carabiner coupling portions of the two fixed cable coupling members 205, 210. It will be appreciated that various types of carabiners may be utilized with the illustrated via ferrata system 200 and remain consistent with embodiments of the present invention. In addition, the energy absorption system 220, 225 (see FIGS. 2 and 3) and corresponding couplings 207, 215, 212 (see FIGS. 2 and 3) are enclosed in an optional sleeve 235 to facilitate efficient operation during normal use. The sleeve 235 covers the energy absorption system 220, 225 but does not substantially impede or affect the tearing of the energy absorbing members 220, 225, nor does it substantially affect the magnitude of expansion forces exerted upon the couplings 207, 212, 215 in various operational scenarios. The sleeve 235 increases efficient and reliable operation of the system 200 by preventing the energy absorption members 220, 225 from snagging or being obstructed. The energy absorption members 220, 225 are specifically folded within the sleeve 235 so as to enable automatic activation and expansion in the event of a fall.

What is claimed is:

1. A via ferrata system comprising:

a harness coupling member;

two fixed cable coupling members;

an energy absorption system coupled to both the harness coupling member and the two fixed cable coupling members, wherein each of the two fixed cable coupling members are independently coupled to the energy absorption system, and wherein the harness coupling member is directly coupled to the energy absorption system, and wherein the two fixed cable coupling members are fixably coupled to one another, and wherein the energy absorption system includes a tear webbing system; and wherein the coupling between the two fixed cable coupling members is weaker than the independent coupling between the two fixed cable coupling members and the energy absorption system, and wherein the coupling between the two fixed cable coupling members is independent of the energy absorption system.

2. The system of claim 1, wherein the coupling between the two fixed cable coupling members is weaker than one of the two fixed cable coupling members.

3. The system of claim 1, wherein the coupling between the two fixed cable coupling members is configured to sever at a force less than a force required to tensile break one of the independent couplings between the two fixed cable coupling members and the energy absorption system.

4. The system of claim 1, wherein the coupling between the two fixed cable coupling members is configured to sever at a force less than a force required to sever one of the independent couplings between the two fixed cable coupling members and the energy absorption system.

5. The system of claim 1, wherein the coupling between the two fixed cable coupling members is configured to sever at a force less than a force required to tensile break one of the two fixed cable coupling members.

6. The system of claim 1, wherein the harness coupling member includes a loop.

7. The system of claim 1, wherein the two fixed cable coupling members independently include elongated nylon members and carabiner coupling portions.

8. The system of claim 1 further including a selectably closeable sleeve configured to cover the energy absorption system.

9. The system of claim 1 further including a carabiner independently coupled to a lengthwise end of each of the fixed cable coupling members lengthwise opposite to the energy absorption system.

10. A via ferrata system comprising:

a harness coupling member;

two fixed cable coupling members;

an energy absorption system directly coupled to the harness coupling member, wherein the energy absorption system includes a tear webbing system;

two independent and direct couplings between the two fixed cable coupling members and the energy absorption system;

a common coupling between the two fixed cable coupling members; and wherein the common coupling is a fixed coupling and is configured to sever at a force less than a force required to tensile break one of the two fixed cable coupling members, and wherein the common coupling is independent of the energy absorption system.

11. The system of claim 10, wherein the common coupling is configured to sever at a force less than a force required to sever one of the two independent couplings.

12. The system of claim 10, wherein the common coupling is configured to sever at a force less than a force required to tensile break one of the two independent couplings.

13. The system of claim 10, wherein the common coupling includes two portions independently coupled to the energy absorption system.

14. The system of claim 10, wherein the common coupling includes a plurality of stitches between nylon portions coupled to the two fixed cable coupling members.

15. The system of claim 10, wherein the two independent couplings include a plurality of stitches between nylon portions coupled to the two fixed cable coupling members and the energy absorption system.

16. The system of claim 10, wherein the harness coupling member includes a loop.

17. The system of claim 10, wherein the two fixed cable coupling members independently include elongated nylon members and carabiner coupling portions.

18. A method of manufacturing a via ferrata system comprising the acts of:

providing a harness coupling member, two fixed cable coupling members, and a energy absorption system, wherein the energy absorption system includes a tear webbing system;

coupling the harness coupling member directly to the energy absorption system;

independently and directly coupling the two fixed cable coupling members to the energy absorption system; and fixably coupling the two fixed cable coupling members together independent of the energy absorption system such that the coupling between the two fixed cable coupling members is configured to sever at a force less than a force required to sever the independent coupling between the two fixed cable coupling members and the energy absorption system.

19. The method of claim 18, wherein the act of coupling the two fixed cable coupling members together further includes configuring the coupling between the two fixed cable coupling members to sever at a force less than a force required to tensile break one of the two fixed cable coupling members.

20. The method of claim 18, wherein the act of coupling the two fixed cable coupling members together further includes configuring the coupling between the two fixed cable coupling members to sever at a force less than a force required to tensile break one of the independent couplings between the two fixed cable coupling members and the energy absorption system.

* * * * *